US012467164B2

(12) United States Patent
Xie et al.

(10) Patent No.: US 12,467,164 B2
(45) Date of Patent: Nov. 11, 2025

(54) SPLIT WEBBING

(71) Applicant: PIONEER ELASTIC (CHINA) LTD., Guangdong (CN)

(72) Inventors: Yuanfen Xie, Guangdong (CN); Xiangcong Huang, Guangdong (CN); Xiqiu Tang, Guangdong (CN)

(73) Assignee: PIONEER ELASTIC (CHINA) LTD., Guangdong (CN)

( * ) Notice: Subject to any disclaimer, the term of this patent is extended or adjusted under 35 U.S.C. 154(b) by 0 days.

(21) Appl. No.: 18/627,537

(22) Filed: Apr. 5, 2024

(65) Prior Publication Data

US 2024/0344246 A1 Oct. 17, 2024

(30) Foreign Application Priority Data

Apr. 17, 2023 (CN) ..... 202310412058.6

(51) Int. Cl.
*D03D 11/02* (2006.01)
*D03D 3/00* (2006.01)
(Continued)

(52) U.S. Cl.
CPC ..... *D03D 3/005* (2013.01); *D03D 3/02* (2013.01); *D03D 15/587* (2021.01)

(58) Field of Classification Search
CPC ..... D03D 3/005; D03D 3/02; D03D 15/587; D03D 11/02; D03D 35/00; D03D 1/0094; D03D 49/60; D10B 2403/022; D03J 1/08
See application file for complete search history.

(56) References Cited

U.S. PATENT DOCUMENTS 281,519 A * 7/1883 Kienzle ..... D03D 11/02 450/156
487,149 A * 11/1892 Krouse et al. ..... D03D 3/005 2/338

(Continued)

FOREIGN PATENT DOCUMENTS

CN 104947292 A 9/2015
CN 209975037 U 1/2020
CN 113463251 A 10/2021

OTHER PUBLICATIONS

"Weaving"; https://glossariz.com/textile/weaving#:~:text=Weaving%20is%20a%20textile%20production%20process%20that%20involves,today%2C%20from%20handloom%20weaving%20to%20industrial-scale%20mass%20production./; Jul. 24, 2024; Accessed Apr. 1, 2025. (Year: 2024).*

*Primary Examiner* — Robert H Muromoto, Jr.
(74) *Attorney, Agent, or Firm* — Schmeiser, Olsen & Watts LLP

(57) ABSTRACT

A split webbing is provided, including: a webbing body woven in one piece by a first and second warp set, a first and a second dividing thread arranged side by side and a weft thread, a closed and a split section provided in sequence along the length of the webbing body, the weft thread being interlaced with the first warp set to form a first sub-webbing, and the weft thread being interlaced with the second warp set to form a second sub-webbing, wherein the inner sides of the first and the second sub-webbing are wound around by the first and the second dividing thread respectively, so as to form a gap between the first and the second sub-webbing, where the weft thread are cut off to separate the first from the second sub-webbing. The split webbing has the advantages of simple weaving control procedure and beautiful product.

7 Claims, 5 Drawing Sheets

(51) Int. Cl.

| | |
|---|---|
| ***D03D 3/02*** | (2006.01) |
| ***D03D 15/587*** | (2021.01) |
| *D03D 25/00* | (2006.01) |

(56) References Cited

U.S. PATENT DOCUMENTS

| | | | | | |
|---|---|---|---|---|---|
| 592,057 | A * | 10/1897 | Knight | D03D 11/02 | 139/389 |
| 2,079,831 | A * | 5/1937 | Bauer, Jr. | D03D 11/02 | 139/389 |
| 3,102,559 | A * | 9/1963 | Koppelman | E04C 2/36 | 139/390 |
| 4,719,837 | A * | 1/1988 | McConnell | D04C 3/12 | 87/8 |
| 5,080,142 | A * | 1/1992 | Calamito | D03D 11/02 | 139/411 |
| 7,841,369 | B1 * | 11/2010 | Osborne | A41D 13/0012 | 139/390 |
| 9,038,520 | B2 * | 5/2015 | Kang | D04C 1/02 | 87/9 |
| 11,466,403 | B2 * | 10/2022 | Ficker | D03D 11/02 | |
| 2008/0042413 | A1 * | 2/2008 | Coleman | D03D 11/02 | 139/389 |
| 2008/0128099 | A1 * | 6/2008 | Amrani | D03D 11/02 | 28/103 |
| 2008/0300602 | A1 * | 12/2008 | Schmitt | D03D 25/005 | 139/384 R |
| 2020/0318270 | A1 * | 10/2020 | Huang | D04C 1/06 | |
| 2021/0025086 | A1 * | 1/2021 | Harvey | D03D 49/16 | |
| 2021/0404095 | A1 * | 12/2021 | You | D03D 11/02 | |
| 2023/0183893 | A1 * | 6/2023 | Jing | D03D 11/02 | 139/421 |

* cited by examiner

SPLIT WEBBING

CROSS-REFERENCE TO RELATED APPLICATIONS

This application claims priority to Chinese Patent Application No. 202310412058.6, filed on Apr. 17, 2023, the entire contents of which are hereby incorporated by reference.

FIELD OF TECHNOLOGY

The following relates to the field of webbing weaving, in particular to split webbing.

BACKGROUND

Webbing is a common accessory in clothing. In practice, it is often necessary to have a split webbing which has both single-webbing and multi-webbing sections on the same webbing. For example, when used on the shoulder straps of women's underwear, a single-webbing section located at the shoulder position is suitable, while a multi-webbing section at the seam of the straps and the cups can make the force more uniform and the connection more durable.

Patent CN209975037U of the applicant discloses split webbing and its weaving method, in which the body of the webbing comprises at least two woven units connected from end to end; each woven unit is divided successively into a first closed section, a split section and a second closed section along the length of the body of the webbing.

When weaving the first closed section, the sides of the closed section are winded both by a first side thread and a second side thread located on the outer sides of the webbing. When weaving the split section, the first side thread is woven diagonally into the webbing from the starting point of the split section, so that the first side thread and the second side thread are finally realized to wind around the first and second sub-webbing of the split section, respectively. When weaving the second closed section, the first side thread is woven diagonally from the end point of the split section to the outside, and finally the sides of the closed section are winded by the first side thread and the second side thread together. However, this weaving method, which uses two side threads for diagonal interlacing, usually leaves obvious oblique thread marks in the transition area on the surface of the webbing, resulting in an uneven appearance of the webbing and reducing the aesthetics of the webbing. At the same time, the weaving process needs to control the two weft threads so that when they enter the split section from the closed section, they change from being woven into all warp threads to being woven into two sets of warp threads respectively, making the control of the weft threads extremely complicated. Alternatively, some existing split webbing is made by cutting the middle of the webbing directly with a cutter, however because the cut side have sides with unclosed threads after cutting, the finished webbing is easily loose due to the lack of hem of the cut side, which has serious quality problems.

SUMMARY

An aspect relates to a split webbing, of which the webbing is beautiful, and makes the force more uniform.

A split webbing comprising: a webbing body in which comprising at least a woven unit; the woven unit comprising a weft thread extending in transverse direction, a plurality of warp threads and dividing threads extending in longitudinal direction; the warp threads are arranged side by side along transverse direction, each two dividing threads are side by side between the warp threads to separate the warp threads into different warp sets, and the weft thread, the warp threads and the dividing threads are interwoven; each woven unit provided with a closed section and a split section in sequence along longitudinal direction; in the closed section, each two dividing threads side by side are close together, and in the split section, a split structure is form between each two dividing threads side by side.

Compared with traditional technology, the split webbing provided by the present application improves the structure of the split webbing, reduces the difficulty of weaving, makes the structure of the finished webbing uniform and beautiful and makes the force more uniform.

For better understanding and implementation, the present application is described in detail below in conjunction with the accompanying drawings.

BRIEF DESCRIPTION

Some of the embodiments will be described in detail, with references to the following Figures, wherein like designations denote like members, wherein.

The designations in the accompanying drawings are.

1. split webbing; 11. a first warp set; 12. a second warp set; 13. a first dividing thread; 14. a second dividing thread; 15. weft thread; 16. hem thread; 17. connecting thread; 18. core yarn; 19. first sub-webbing; 20. second sub-webbing; A. closed section; B. split section; C. gap; a. first layer thread set; b. second layer thread set; 2. frame; 3. lifting heald assembly; 31. lifting heald; 32. doup heald; 33. loose heald; 4. reed assembly; 41. motor; 42. drive rod; 43. connecting rod; 44. articulated shaft; 45. mounting shaft; 46. reed holder; 47. reed member; 471. outer frame; 472. left reed; 4721. a first inclined section; 4722. a first vertical section; 473. right reed; 4731. a first inclined section; 4732. a second vertical section; 474. threading clearance; 5. cutting assembly; 51. mounting bracket; 52. drive cylinder; 53. slider; 54. rotating shaft; 55. drive unit; 56. cutter.

DETAILED DESCRIPTION

Embodiment 1

Figure 1:
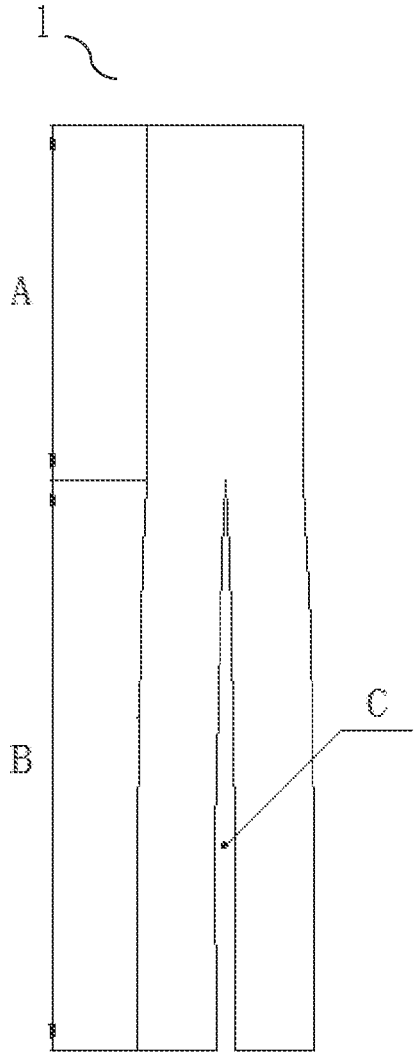
FIG. 1 is a schematic structural diagram of the split webbing.
Figure 2:
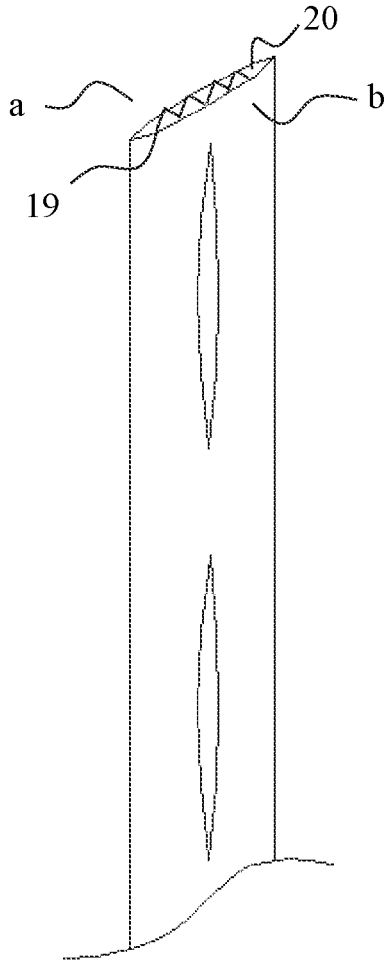
FIG. 2 is a schematic diagram of a plurality of woven units connected end to end.
Figure 3:
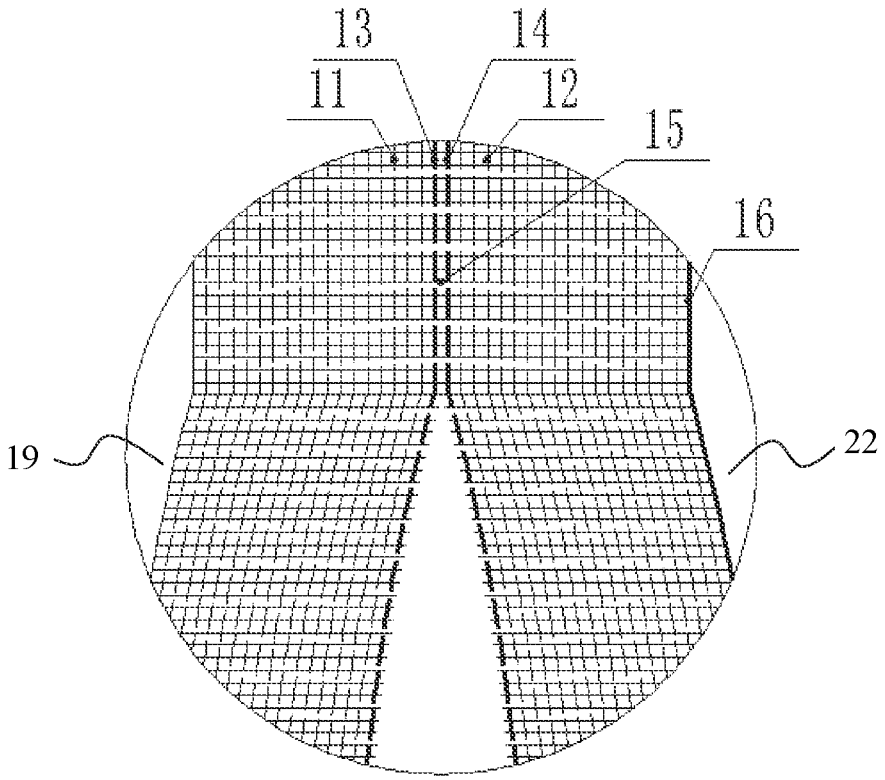
FIG. 3 is a schematic diagram of the interlaced structure of the split webbing.
Figure 4:
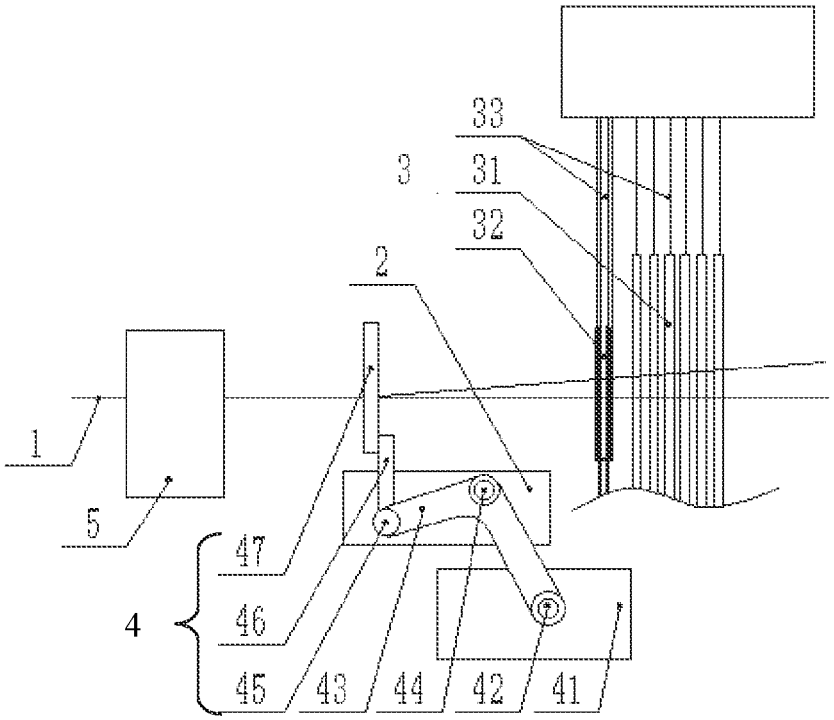
FIG. 4 is a schematic structural diagram of the loom.
Figure 5:
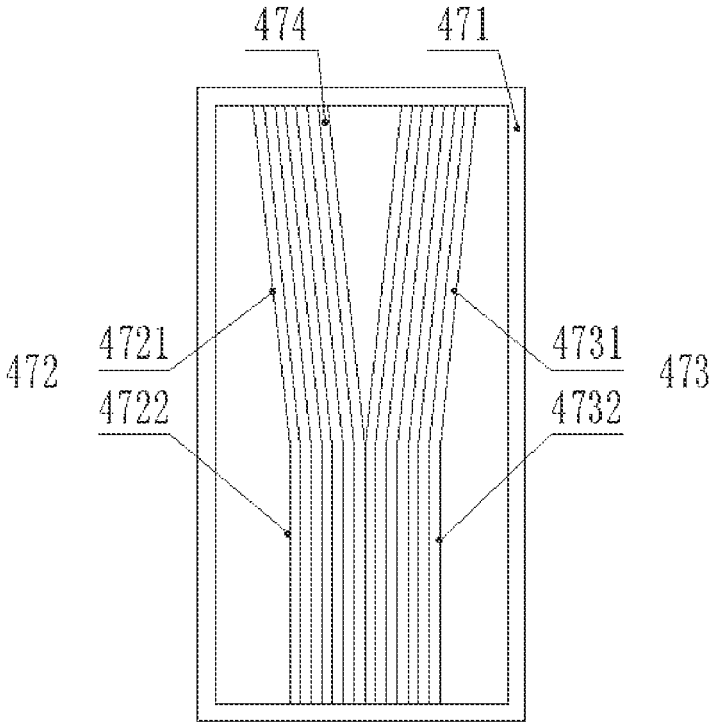
FIG. 5 is a schematic structural diagram of the reed member.
Figure 6:
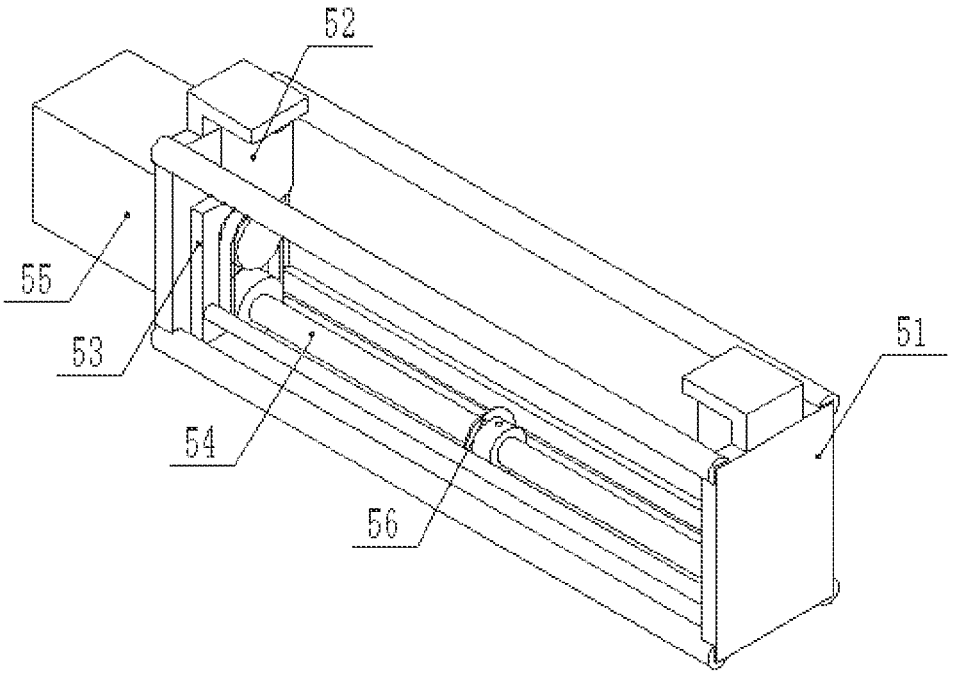
FIG. 6 is a schematic structural diagram of the cutting assembly.

FIG. 1 shows a schematic structural diagram of the split webbing; FIG. 2 shows a schematic diagram of a plurality of woven units connected end to end; FIG. 3 shows a schematic diagram of the interlaced structure of the split webbing; FIG. 4 shows a schematic structural diagram of the loom; FIG. 5 shows a schematic structural diagram of the reed member; and FIG. 6 shows a schematic structural diagram of the cutting assembly.

The split webbing provided by the present application comprises a plurality of warp threads and two dividing threads distributed in the same direction along longitudinal direction, and a weft thread 15 extending in transverse direction. The warp threads, dividing threads and weft thread are integrally woven to form a webbing body which constitutes forked webbing. The split webbing further comprises a hem thread 16 to wind around the outer side of the webbing as a side closure.

In the transverse direction, the plurality of warp threads is arranged in parallel, each two dividing threads are arranged in parallel between the warp threads to separate the warp threads into different sets, the dividing threads are made of the same material as the warp threads they are wound with, which are wrapped root threads in an embodiment. In an embodiment, the plurality of warp threads is divided into a first warp set 11 and a second warp set 12, and the dividing threads are located between the first warp thread set 11 and the second warp thread set 12.

The webbing body includes a woven unit or at least two woven units connected from end to end, and each woven unit is cut according to the actual product requirements after the weaving is completed. Each woven unit is provided with a closed section A and a split section B in sequence along the longitudinal direction. In the closed section A, each two dividing threads side by side are close together, and in the split section B, the space between each two dividing threads side by side is much larger than the space between each two adjacent warp threads to form a split structure in the woven unit, in which:

The closed sections A are all interwoven by the first warp set 11 and the second warp set 12, the first dividing thread 13, the second dividing thread 14 with the weft thread 15 to form a first flat tubular structure. Specifically, a group of the first warp set 11 and the second warp set 12, the first dividing thread 13, the second dividing thread 14 are arranged in the same plane to form a first layer thread set a, the other group of the first warp set 11 and the second warp set 12, the first dividing thread 13, the second dividing thread 14 are arranged in the other plane to form a second layer thread set b. The first layer thread set a stacks on the second layer thread set b, the first warp set 11 of the first layer thread set a is arranged relative to the first warp set 11 of the second layer thread set b, the second warp set 12 of the first layer thread set a is arranged relative to the second warp set 12 of the second layer thread set b, the weft thread 15 is interwoven with the first warp set 11, the first dividing thread 13, the second dividing thread 14 and the second warp set 12 of the first layer thread set a in sequence, and then winds to the second layer thread set b, and interwoven with the second warp set 12, the second dividing thread 14, the first dividing thread 13, and the first warp set 11 of the second layer thread set b in sequence, and then interwoven with the first layer thread set a, so repeated until the weaving of the closed sections A is completed.

The split section B is divided into a first sub-webbing 19 and a second sub-webbing 20. The first sub-webbing 19 is interwoven by the first warp set 11 and the weft thread 15 to form a second flat tubular structure with its side near the second sub-webbing 20 winded by the first dividing thread 13. The second sub-webbing 20 is interwoven by the second warp set 12 and the weft thread 15 to form a third flat tubular structure with its side near the first sub-webbing 19 winded by the first dividing thread 14.

In an embodiment, the first sub-webbings 19 and the second sub-webbings 20 are of equal width. Apart from this, the position of the dividing threads in the warp threads can be adjusted according to the design so that a split structure with unequal bandwidths of the first sub-webbings 19 and the second sub-webbings 20 can be woven.

The two dividing threads are spaced apart from each other to form a gap C. The weft thread 15 in gap C is cut by a cutter to achieve the separation of the first and second sub-webbings.

The second flat tubular structure and the third flat tubular structure are each connected to the first flat tubular structure. Specifically, in the split section B, the first dividing thread 13 and the second dividing thread 14 of the first layer thread set a are separated, in the same way the first dividing thread 13 and the second dividing thread 14 of the second layer thread set b are separated. The first warp set 11 and the first dividing thread 13 of the first layer thread set a stack on the first warp set 11 and the first dividing thread 13 of the second layer thread set b to form the first sub-webbing 19; the second dividing thread 14 and the second warp set 12 of the first layer thread set a stack on the second dividing thread 14 and the second warp set 12 of the second layer thread set b to form the second sub-webbing 20. The weft thread 15 interwoven with the first layer thread set a and the second layer thread set b is cut between the first dividing thread 13 and the second dividing thread 14. While the first layer thread set a, the second layer thread set b and the weft thread 15 are interwoven, the first dividing thread 13 of the first layer thread set a and the second layer thread set b are alternately moved and twisted as the following steps: while the first dividing thread 13 of the first layer thread set a is moved to the second layer thread set b, the first dividing thread 13 of the second layer thread set b is moved to the first layer thread set a, then the first dividing thread 13 of the first layer thread set a returns to the first layer thread set a, at the same time the first dividing thread 13 of the second layer thread set b returns to the second layer thread set b, the first dividing thread 13 of the first layer thread set a is crossed with the first dividing thread 13 of the second layer thread set b, and the weft thread 15 is between the two first dividing threads 13. The second dividing thread 14 of the first layer thread set a and the second layer thread set b are also moved alternately and twisted according to the above steps.

In an embodiment, the weft thread 15 is made of low melting point yarn, so that the low melting point yarn will dissolve and adhere to the warp threads thereof after the dyeing process, so that the webbing will not come apart when it is cut at any position in the horizontal direction, because the weft thread 15 is cut off before dyeing and finishing, which changes the stability of the yarn, the part where the webbing is divided can also ensure that it will not come apart when it is washed in hot water and will stand up to washing.

In an embodiment, a connecting thread 17 and a core yarn 18 are also included. The connecting thread 17 reciprocates through the webbing body along the thickness direction of the webbing to connect the upper and lower layers of the webbing. The core yarn 18 fills the inner cavity of the webbing to make the webbing fuller. During production, the webbing body is filled with the core yarn 18 and connected with the connecting thread 17.

While a plurality of woven units connected end to end, the split section B of the front woven unit is connected to the closed section A of the back woven unit.

The existing loom needs to be improved so as to meet the above-mentioned weaving process of the split webbing.

A loom for weaving the split webbing is provided, which comprises a frame 2, a lifting heald assembly 3, a reed assembly 4 and a cutting assembly 5. The lifting heald assembly 3 comprises a lifting heald 31, a doup heald 32, a signal heald (not shown), and a plurality of loose healds 33 each driven by an electronic jacquard machine for up and down movement. The lifting healds 31 are connected to the loose healds 33 and are provided with heald eyes for threading the warp threads.

The doup heald 32 is provided in two sets which are threaded with a first dividing thread 13 and a second dividing thread 14 respectively. The doup heald 32 is connected with the loose healds 33. In an embodiment, the doup heald 32 is a LENO heald, comprising two base healds on the left and right and one half heald, which are fixed by hanging the two legs thereof upwards on the frame. The base healds are connected to the loose healds 33 so that the first and second dividing threads 13 and 14 are wound around their adjacent warp threads in the split section to prevent the webbing from falling apart after cutting. The weaving principle is not repeated here.

The signal heald is connected to the loose healds 33 which can be of the same structure as the lifting heald 31, and output signals to change structure of the split webbing 1 by moving up and down, thus controlling the cutting and separation of the webbing by the cutting assembly 5.

The reed assembly 4 includes a motor 41, a drive rod 42, a connecting rod 43, an articulated shaft 44, a mounting shaft 45 and a reed unit. The motor 41 is mounted on the frame 2 and its output end is connected to the drive rod 42. The connecting rod 43 is hinged to the articulated shaft 44 of the frame 2, one end of which is hinged to the drive rod 42 and the other end is hinged to the mounting shaft 45. When the motor 41 drives the drive rod 42 to move, the connecting rod 43 swings around the hinge shaft 44 accordingly, thereby driving the mounting shaft 45 for height adjustment.

The reed unit is used in conjunction with weft hooks and side closure structure to weave the webbing, the number of which corresponds to that of the sub-webbings. For example, in an embodiment, in order to weave the split webbing 1, only one set of reed unit is needed. If the split webbing with 2 slits is woven at the same time, two sets of reed units are provided. The reed unit includes a reed holder 46 and a reed member 47, which is installed on the mounting shaft 45 through the reed holder 46.

The reed member 47 includes an outer frame 471 and a reed set provided in the outer frame 471. The reed set includes a left reed set and a right reed set. The left reed set includes a plurality of left reeds 472 arranged at intervals. One end of each of the left reeds is connected to the top of the outer frame 471 and the other end is connected to the bottom of the outer frame 471. And each of the left reeds is provided with a first inclined section 4721 and a first vertical section 4722 integrally formed from top to bottom, in which the first inclined section 4721 is inclined from top to bottom in the direction away from the right reed 473 set. The right reed set includes a plurality of right reeds 473 arranged at intervals. One end of each of the right reeds is connected to the top of the outer frame 471 and the other end is connected to the bottom of the outer frame 471. And each of the right reeds is provided with a first inclined section 4731 and a first vertical section 4732 integrally formed from top to bottom, wherein the first inclined section 4721 is inclined from top to bottom in the direction away from the right reed 472 set.

The first vertical section 4722 and the second vertical section 4732 are evenly spaced apart to form a threading clearance 474. The warp threads and dividing threads are threaded in the threading clearances 474 and slide between the inclined and vertical sections as the reed member 47 moving up and down to achieve switching of the closed section A and the split section B.

The left reed and right reed sets are fitted together in the direction of the reed arrangement so as to minimize the distance between the dividing threads and to avoid puckering in the middle of the webbing during weaving of the closed section A. In an embodiment, the number of left reeds 472 and the number of right reeds 473 can be designed according to the actual situation. In order to weave a first and a second sub-webbing with equal width, the left reed 472 and the right reed 473 are set symmetrically, i.e. the left reed 472 and the right reed 473 are equal in number, forming a Y-shaped structure.

The cutting assembly 5 is set on the frame 2 to cut the finished webbing, including a mounting bracket 51 arranged on the frame 2, drive cylinders 52 arranged symmetrically on both sides of the mounting bracket 51, in an embodiment is air cylinders (not limited to an air cylinder, but the use of motor 41 is prone to frequent stoppages due to overload), and a slider 53 arranged at the output end of the drive cylinders and rotatably provided with a rotating shaft 54 which is driven to rotate by drive unit 55. The rotating shaft 54 is provided with at least one cutter 56, the position of which is adjustable and fastened by screws. The signal source of the cylinder is the signal heald. When the weaving of the split section B is not carried out, the cylinder starts driving the slider 53 upward, so that the head of the cutter 56 is away from the webbing and no cutting of the webbing is carried out; when the weaving of the split section B is carried out, the cylinder starts driving the slider 53 downward, so that the head of the cutter 56 reaches the gap C, thus cutting the weft thread 15 therein to divide the webbing.

The loom further comprises a control unit (not shown) comprising an operating screen and a controller, the controller being electrically connected to the electronic jacquard machine, power sources, motors and other systems of the loom and the like, which is in conjunction with a variety of sensors, to achieve precise adjustment of the loom.

The weaving method for the split webbing 1 is as follows:

S1: Weaving a woven unit;

Cutting the split section of the woven unit.

Specifically, the step of S1 comprises the steps of:

S1.1: Weaving a closed section A.

At this step, a first dividing thread 13 and a second dividing thread 14 are interlaced with warp threads and a weft thread 15 together, and a reed member 47 is driven to move up so that the first dividing thread 13, the second dividing thread 14 and the warp threads are threaded between vertical sections.

S1.2: Weaving a split section B.

At this step, the reed member 47 is driven to move down, so that the first dividing thread 13, the second dividing thread 14 and the warp threads are threaded between inclined sections, and the warp threads are separated from the left and right and both are interlaced with the weft thread 15 to form a first sub-webbing 19 and a second sub-webbing 20 that are connected to each other. The first dividing thread 13 and the second dividing thread 14 wind the sides of the first and the second sub-webbing 19, 20 respectively, and a gap C is formed between the dividing threads.

S1.3: Repeating the step of S1.1.

Specifically, the step of S2 comprises the steps of:

S2.1: When weaving the closed section A, a cutter 56 moves up, so as not to contact with the webbing;

S2.2: When weaving the split section B, the cutter 56 moves down to cut the weft thread 15 in the gap C and the first sub-webbing 19 are separated from the second sub-webbing 20.

Embodiment 2

Figure 7:
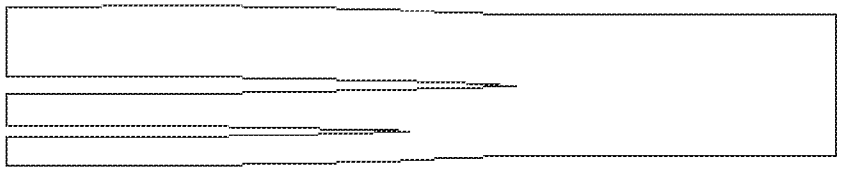
FIG. 7 is a schematic diagram of the trifurcated webbing described in Embodiment 2.

FIG. 7 shows a schematic diagram of the trifurcated webbing of this embodiment. This embodiment is basically the same as embodiment 1, the difference only lies in that the split webbing can be trifurcated according to actual needs, i.e. the split section is divided into a first sub-webbing, a second sub-webbing and a third sub-webbing. In this embodiment, it is necessary to add a third dividing thread and a fourth dividing thread in the warp threads, which are used to wind the sides of the bifurcated parts of the second and third sub-webbing, and which are also used to adjust the position of each bifurcation to achieve a staggered bifurcation, referring to FIG. 7. The working process of the third and the fourth dividing threads is similar to the first and the second ones, which will not be repeated herein. To weave the structure of the trifurcated webbing, the reed set also includes a middle reed set sandwiched between the left reed set and the right reed set, which includes a plurality of middle reeds, which can be arranged as a third inclined section and a third vertical section integrally formed, or only a third vertical section.

In some embodiments, a four-fork webbing structure and so on can also be obtained if the webbing structure allows.

Embodiments of the present application disclose a split webbing and its loom and weaving method, which improves the structure and weaving method of split webbing, reduces the weaving difficulty and control difficulty of split webbing, improves the diversity of structures of split webbing, and makes the finished product uniform and beautiful without messy thread traces on the surface thereof.

Although the present invention has been disclosed in the form of embodiments and variations thereon, it will be understood that numerous additional modifications and variations could be made thereto without departing from the scope of the invention.

For the sake of clarity, it is to be understood that the use of 'a' or 'an' throughout this application does not exclude a plurality.

The invention claimed is:

1. A split webbing comprising: a webbing body having at least a woven unit; the woven unit including a weft thread extending in transverse direction, a plurality of warp threads and dividing threads extending in longitudinal direction; the warp threads are arranged side by side along transverse direction, each two dividing threads are side by side between the warp threads to separate the warp threads into different warp sets, and the weft thread, the warp threads and the dividing threads are interwoven; each woven unit provided with a closed section and a split section in sequence along longitudinal direction; in the closed section, each two dividing threads side by side are close together, and in the split section, a split structure is form between each two dividing threads side by side;

wherein the closed section is at least woven by a first warp set and a second warp set, a first dividing thread and a second dividing thread with the weft thread to form a first flat tubular structure; in the split section having at least a first sub-webbing and a second sub-webbing, the weft thread being interlaced with the first warp set to form the first sub-webbing, and the weft thread being interlaced with the second warp set to form the second sub-webbing, wherein the first sub-webbing and the second sub-webbing are in the form of a flat tube, and the tube cavities of which are connected to that of the first flat tubular structure, wherein the inner sides of the first sub-webbing and the second sub-webbing are wound around by the first dividing thread and the second dividing thread respectively, so as to form the split structure between the first sub-webbing and the second sub-webbing;

wherein a group of the first warp set and the second warp set, the first dividing thread, the second dividing thread are arranged in the same plane to form a first layer thread set, the other group of the first warp set and the second warp set, the first dividing thread, the second dividing thread are arranged in the other plane to form a second layer thread set, the first layer thread set stacks on the second layer thread set, the weft thread is interwoven with the first warp set and the second warp set;

wherein a connecting thread is further comprised, the connecting thread reciprocating through the webbing body along the thickness direction of the webbing to connect the upper and lower layers of the webbing;

wherein a connecting thread is further comprised, the connecting thread reciprocating through the webbing body along the thickness direction of the webbing to connect the upper and lower layers of the webbing.

2. The split webbing of claim 1, wherein the weft thread is made of low melting point yarn.

3. The split webbing of claim 1, wherein the bandwidths of the first sub-webbing and the second sub-webbing are equal or unequal.

4. The split webbing of claim 1, wherein a core yarn is further comprised, the core yarn filling the inner cavity of the webbing to make the webbing fuller.

5. The split webbing of claim 1, wherein the webbing body further comprising at least two woven units connected from end to end, the split section of the front woven unit is connected to the closed section of the back woven unit.

6. The split webbing of claim 1, wherein three or more split structures are in the same webbing body.

7. The split webbing of claim 1, wherein the bandwidths of different split structures in the same webbing body are equal or unequal.

* * * * *